US010192730B2

(12) United States Patent
Weisbrod et al.

(10) Patent No.: US 10,192,730 B2
(45) Date of Patent: Jan. 29, 2019

(54) METHODS FOR OPERATING ELECTROSTATIC TRAP MASS ANALYZERS

(71) Applicant: Thermo Finnigan LLC, San Jose, CA (US)

(72) Inventors: Chad R. Weisbrod, San Jose, CA (US); Michael W. Senko, Sunnyvale, CA (US); Jesse D. Canterbury, San Jose, CA (US); John E. P. Syka, Charlottesville, VA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 15/252,025

(22) Filed: Aug. 30, 2016

(65) Prior Publication Data

US 2018/0061625 A1 Mar. 1, 2018

(51) Int. Cl.
*H01J 49/42* (2006.01)
*H01J 49/00* (2006.01)

(52) U.S. Cl.
CPC ..... *H01J 49/4245* (2013.01); *H01J 49/0031* (2013.01); *H01J 49/426* (2013.01); *H01J 49/4275* (2013.01)

(58) Field of Classification Search
CPC .... H01J 49/425; H01J 49/4275; H01J 49/428; H01J 49/4285; H01J 49/429; H01J 49/424; H01J 49/4245
See application file for complete search history.

(56) References Cited

U.S. PATENT DOCUMENTS 3,334,225 A * 8/1967 Langmuir ..... H01J 49/4215 250/292
5,179,278 A * 1/1993 Douglas ..... H01J 49/4225 250/290
5,710,427 A * 1/1998 Schubert ..... H01J 49/424 250/282

(Continued)

OTHER PUBLICATIONS

Wu et al., "Ion trajectory simulations of axial ac dipolar excitation in the Orbitrap", International Journal of Mass Spectrometry, vol. 254 (2006), pp. 53-62.

(Continued)

*Primary Examiner* — Nicole Ippolito
*Assistant Examiner* — Sean Luck
(74) *Attorney, Agent, or Firm* — Thomas F. Cooney

(57) ABSTRACT

A method of operating an electrostatic trapping mass analyzer, comprising: introducing a sample of ions into a trapping region of the mass analyzer, wherein a trapping field within the trapping region is such that the ions exhibit radial motion with respect to a central longitudinal axis of the trapping region while undergoing harmonic motion in a dimension defined by the central longitudinal axis, the frequency of harmonic motion of a particular ion being a function of its mass-to-charge ratio; superimposing a modulation field onto the trapping field within the trapping region, the modulation field acting to either increase or reduce the harmonic motion energies of the ions by an amount varying according to the frequency of harmonic motion; and acquiring a mass spectrum of the ions in the trapping region by measuring a signal representative of an image current induced by the harmonic motion of the ions.

12 Claims, 7 Drawing Sheets

(56) References Cited

U.S. PATENT DOCUMENTS

| | | | | |
|---|---|---|---|---|
| 5,886,346 | A | 3/1999 | Makarov | |
| 6,872,938 | B2 | 3/2005 | Makarov et al. | |
| 7,321,847 | B1 * | 1/2008 | Welkie | H01J 49/0036 702/189 |
| 7,399,962 | B2 | 7/2008 | Makarov | |
| 7,498,571 | B2 | 3/2009 | Makarov et al. | |
| 7,714,283 | B2 | 5/2010 | Makarov et al. | |
| 7,728,288 | B2 | 6/2010 | Makarov et al. | |
| 7,994,473 | B2 | 8/2011 | Koester | |
| 8,017,909 | B2 | 9/2011 | Makarov et al. | |
| 8,735,812 | B2 | 5/2014 | Koester | |
| 8,853,620 | B2 | 10/2014 | Lange | |
| 2002/0166958 | A1 * | 11/2002 | Afeyan | G01N 30/72 250/282 |
| 2003/0071211 | A1 * | 4/2003 | Kawato | H01J 49/429 250/300 |
| 2003/0213908 | A1 * | 11/2003 | Umemura | H01J 49/424 250/292 |
| 2004/0061050 | A1 * | 4/2004 | Kato | H01J 49/424 250/292 |
| 2005/0253064 | A1 | 11/2005 | Loboda et al. | |
| 2006/0124845 | A1 | 6/2006 | Makarov et al. | |
| 2008/0203293 | A1 * | 8/2008 | Makarov | H01J 49/0009 250/283 |
| 2012/0109537 | A1 * | 5/2012 | Makarov | H01J 49/0036 702/27 |
| 2012/0112056 | A1 | 5/2012 | Brucker et al. | |
| 2012/0267526 | A1 | 10/2012 | Green | |
| 2013/0334414 | A1 * | 12/2013 | McAlister | H01J 49/0031 250/283 |
| 2015/0364303 | A1 | 12/2015 | Remes et al. | |
| 2015/0380232 | A1 * | 12/2015 | Brown | H01J 49/428 250/282 |
| 2016/0314951 | A1 * | 10/2016 | Aizikov | H01J 49/0036 |

OTHER PUBLICATIONS

Perry et al., "Orbitrap Mass Spectrometry: Instrumentation, Ion Motion and Applications", Mass Spectrometry Reviews, 2008, 27, pp. 661-699.

Perry et al., "Rephasing Ion Packets in the Orbitrap Mass Analyzer to Improve Resolution and Peak Shape", J Am Soc Mass Spectrom 2009, 20, pp. 1397-1404.

Alexander Makarov, "Electrostatic Axially Harmonic Orbital Trapping: A High-Performance Technique of Mass Analysis," Chem. 2000, 72, pp. 1156-1162.

Claus Koester, "The concept of electrostatic non-orbital harmonic ion trapping", International Journal of Mass Spectrometry 287, 2009, pp. 114-118.

Hu et al., "Resonant ac Dipolar Excitation for Ion Motion Control in the Orbitrap Mass Analyzer" J. Phys. Chem. A 2006, 110, pp. 2682-2689.

Kaiser et al., "Tailored Ion Radius Distribution for Increased Dynamic Range in FT-ICR Mass Analysis of Complex Mixtures", Anal. Chem. 2013, 85, pp. 265-272.

Scigelova et al., "Orbitrap Mass Analyzer—Overview and Applications in Proteomics", Practical Proteomics 1-2/2006 pp. 16-21.

* cited by examiner

21
Signal (arbitrary)
0.00
0.05
0.10
0.15
0.20
0.25
Time (ms)

22
Signal (arbitrary)
Time

METHODS FOR OPERATING ELECTROSTATIC TRAP MASS ANALYZERS

FIELD OF THE INVENTION

The present invention relates generally to mass spectrometry and mass spectrometers and, more particularly, relates to operation of electrostatic trap mass analyzers and to operation of mass spectrometer systems employing electrostatic trap mass analyzers.

BACKGROUND OF THE INVENTION

Electrostatic traps are a class of ion optical devices where moving ions experience multiple reflections or deflections in substantially electrostatic fields. Unlike for trapping in RF field ion traps, trapping in electrostatic traps is possible only for moving ions. Thus, a high vacuum is required to ensure that this movement takes place with minimal loss of ion energy due to collisions over a data acquisition time $T_m$. Since its commercial introduction in 2005, the ORBITRAP™ mass analyzer, which belongs to the class of electrostatic trap mass analyzers, has become widely recognized as a useful tool for mass spectrometric analysis. In brief, the ORBITRAP™ mass analyzer, which is commercially available from Thermo Fisher Scientific of Waltham Mass. USA, is a type of electrostatic trap mass analyzer that is substantially modified from the earlier Kingdon ion trap. FIGS. 1A and 1B, discussed further below, provide schematic illustrations of an ORBITRAP™ mass analyzer. The main advantages of electrostatic trapping mass analyzers of the type illustrated in FIGS. 1A-1B and of mass spectrometer systems that incorporate such mass analyzers are that they provide accurate mass-to-charge (m/z) measurements and high m/z resolution similar to what is achievable with Fourier Transform Ion Cyclotron Resonance (FT-ICR) mass spectrometry instrumentation but without the requirement for a high-strength magnet. Structural and operational details of ORBITRAP™ mass analyzers and mass spectrometers employing such mass analyzers are described in Makarov, Electrostatic Axially Harmonic Orbital Trapping: A High-Performance Technique of Mass Analysis, Anal. Chem., 72(6), 2000, pp. 1156-1162 and in U.S. Pat. No. 5,886,346 in the name of inventor Makarov and in U.S. Pat. No. 6,872,938 in the names of inventors Makarov et al.

In both FT-ICR and ORBITRAP™ mass analyzers, ions are compelled to undergo collective oscillatory motion within the analyzer which induces a correspondingly oscillatory image charge in neighboring detection electrodes, thereby enabling detection of the ions. The oscillatory motion used for detection may be of various forms including, for example, circular oscillatory motion in the case of FT-ICR and axial oscillatory motion while orbiting about a central electrode in the case of a mass analyzer of the type schematically illustrated in FIGS. 1A-1B or a mass spectrometer employing such a mass analyzer. The oscillatory image charge in turn induces an oscillatory image current and corresponding voltage in circuitry connected to the detection electrodes, which is then typically amplified, digitized and stored in computer memory which is referred to as a transient (i.e. a transitory signal in the time domain). The oscillating ions induce oscillatory image charge and oscillatory current at frequencies which are related to the mass-to-charge (m/z) values of the ions. Each ion of a given mass to charge (m/z) value will oscillate at a corresponding given frequency such that it contributes a signal to the collective ion image current which is generally in the form of a periodic wave at the given frequency. The total detected image current of the transient is then the resultant sum of the image currents at all the frequencies present (i.e. a sum of periodic signals). Frequency spectrum analysis (such as Fourier transformation) of the transient yields the oscillation frequencies associated with the particular detected oscillating ions; from the frequencies, the m/z values of the ions can be determined (i.e. the mass spectrum) by known equations with parameters determined by prior calibration experiments.

More specifically, an ORBITRAP™ mass analyzer includes an outer barrel-like electrode and a central spindle-like electrode along the axis. Referring to FIG. 1A, a portion of a mass spectrometer system including an ORBITRAP™ mass analyzer is schematically shown in longitudinal section view. The mass spectrometer system 1 includes an ion injection device 2 and an electrostatic orbital trapping mass analyzer 4. The ion injection device 2, in this case, is a curved multipolar curvi-linear trap (known as a "C-trap"). Ions are ejected radially from the "C-trap" in a pulse to the Orbitrap. For details of the curved trap, or C-trap, apparatus and its coupling to an electrostatic trap, please see U.S. Pat. Nos. 6,872,938; 7,498,571; 7,714,283; 7,728,288; and 8,017,909 each of which is hereby incorporated herein by reference in its entirety. The C-trap may receive and trap ions from an ion source 3 which may be any known type of source such as an electrospray (ESI) ion source, a Matrix-Assisted Laser Desorption Ionization (MALDI) ion source, a Chemical Ionization (CI) ion source, an Electron Ionization (EI) ion source, etc. Additional not-illustrated ion processing components such as ion guiding components, mass filtering components, linear ion trapping components, ion fragmentation components, etc. may optionally be included (and frequently are included) between the ion source 3 and the C-trap 2 or between the C-trap and other parts of the mass spectrometer. Other parts of the mass spectrometer which are not shown are conventional, such as additional ion optics, vacuum pumping system, power supplies etc.

Other types of ion injection devices may be employed in place of the C-trap. For example, the aforementioned U.S. Pat. No. 6,872,938 teaches the use of an injection assembly comprising a segmented quadrupole linear ion trap having an entrance segment, an exit segment, an entrance lens adjacent to the entrance segment and an exit lens adjacent to the exit segment. By appropriate application of "direct-current" (DC) voltages on the two lenses as well as on the rods of each segment, a temporary axial potential well may be created in the axial direction within the exit segment. The pressure inside the trap is chosen in such a way that ions lose sufficient kinetic energy during their first pass through the trap such that they accumulate near the bottom of the axial potential well. Subsequent application of an appropriate voltage pulse to the exit lens combined with ramping of the voltage on a central spindle electrode causes the ions to be emptied from the trap axially through the exit lens electrode and to pass into the electrostatic orbital trapping mass analyzer 4.

The electrostatic orbital trapping mass analyzer 4 comprises a central spindle shaped electrode 6 and a surrounding outer electrode which is separated into two halves 8*a* and 8*b*. FIG. 1B is an enlarged cross-sectional view of the inner and outer electrodes. The annular space 17 between the inner spindle electrode 6 and the outer electrode halves 8*a* and 8*b* is the volume in which the ions orbit and oscillate and comprises a measurement chamber in that the motion of ions within this volume induces the measured signal that is used to determine the ions m/z ratios and relative abundances. The internal and external electrodes (electrodes 6 and 8*a*, 8*b*) are specifically shaped such that, when supplied with appropriate voltages will produce respective electric fields which interact so as to generate, within the measurement chamber 17, a so-called "quadro-logarithmic potential", U, (also sometimes referred to as a "hyper-logarithmic potential") which is described in cylindrical coordinates (r, z) by the following equation:

$$U = \frac{a}{2}\left(z^2 - \frac{r^2}{2}\right) + b\ln\left(\frac{r}{c}\right) + d \qquad \text{Eq. 1}$$

where a, b, c, and d are constants determined by the dimensions of and the voltage applied to the orbital trapping analyzer electrodes, where z=0 is taken at the axial position corresponding to the equatorial plane of symmetry 7 of the electrode structure and chamber 17 as shown in FIG. 1B. The "bottom" or zero axial gradient point of the portion of "quadro-logarithmic potential" dependent on the axial displacement (i.e. the portion which determines motion in the axial dimension, z, along the longitudinal axis 9) occurs at the equatorial plane 7. This potential field has a harmonic potential well along the axial (Z) direction which allows an ion to be trapped axially within the potential well if it does not have enough kinetic energy to escape. It should be noted that Eq. 1 represents an ideal functional form of the electrical potential and that the actual potential in any particular physical apparatus will include higher-order terms in both z and r.

The motions of trapped ions are associated with three characteristic oscillation frequencies: a frequency of rotation around the central electrode 6, a frequency of radial oscillations a nominal rotational radius and a frequency of axial oscillations along the z-axis. In order to detect the frequencies of oscillations, the motion of ions of a given m/z need to be coherent. The radial and rotational oscillations are only partially coherent for ions of the same m/z as differences in average orbital radius and size of radial oscillations correspond to different orbital and radial frequencies. It is easiest to induce coherence in the axial oscillations as ions move in an axial harmonic potential so axial oscillation frequency is independent of oscillation amplitude and depends only on m/z and, therefore, the axial oscillation frequencies are the only ones used for mass-to-charge ratio determinations. The outer electrode is formed in two parts 8*a*, 8*b* as described above and is shown in FIG. 1B. The ions oscillate sinusoidally with a frequency, ω, (harmonic motion) in the potential well of the field in the axial direction according to the following Eq. 2:

$$\omega = \sqrt{\frac{k}{(m/z)}} \qquad \text{Eq. 2}$$

where k is a constant. One or both parts 8*a*, 8*b* of the outer electrode are used to detect image current as the ions oscillate back and forth axially. The Fourier transform of the induced ion image current signal from the time domain to the frequency domain can thus produce a mass spectrum in a conventional manner. This mode of detection makes possible high mass resolving powers.

Ions having various m/z values which are trapped within the C-trap are injected from the C-trap into the electrostatic orbital trapping mass analyzer 4 in a temporally and spatially short packet at an offset ion inlet aperture 5 that is located at an axial position which is offset from the equatorial plane 7 of the analyzer in order to achieve "excitation by injection" whereby the ions of the ion packet immediately commence oscillation within the mass analyzer in the quadro-logarithmic potential. The ions oscillate axially between the two outer electrodes 8*a* and 8*b* while also orbiting around the inner electrode 6. The axial oscillation frequency of an ion is dependent on the m/z values of the ions contained within the ion packet so that ions in the packet with different m/z begin to oscillate at different frequencies.

The two outer electrodes 8*a* and 8*b* serve as detection electrodes. The oscillation of the ions in the mass analyzer causes an image charge to be induced in the electrodes 8*a* and 8*b* and the resulting image current in the connected circuitry is picked-up as a signal and amplified by an amplifier 10 (FIG. 1A) connected to the two outer electrodes 8*a* and 8*b* which is then digitized by a digitizer 12. The resulting digitized signal (i.e. the transient) is then received by an information processor 14 and stored in memory. The memory may be part of the information processor 14 or separate, preferably part of the information processor 14. For example, the information processor 14 may comprise a computer running a program having elements of program code designed for processing the transient. The computer 14 may be connected to an output means 16, which can comprise one or more of: an output visual display unit, a printer, a data writer or the like.

The transient received by the information processor 14 represents the mixture of the image currents produced by the ions of different m/z values which oscillate at different frequencies in the mass analyzer. A transient signal for ions of one m/z is periodic as shown in FIG. 2A, which shows a "symbolic" approximately sinusoidal transient 21 for just a few oscillations of a single frequency (m/z) component. A representative transient 22 obtained when several different frequencies are combined is shown in FIG. 2B. The m/z value of the ion determines the period (and frequency) of the periodic function. The Single Transient Signal (STS) for single frequency component corresponding to oscillation of ions having mass-to-charge ratio $(m/z)_1$ is approximated by:

$$STS = A\sin(2\pi\omega t + \varphi_0) \qquad \text{Eq.3}$$

where A is a measure of the abundance (quantity) of ions having mass-to-charge ratio $(m/z)_1$ in the trap, ω is the frequency, t is time and $\varphi_0$ is the initial phase (at t=0). This equation is only an approximation because it does not account for decay of the amplitude and loss of coherence over time.

The information processor 14 performs a Fourier transformation on the received transient. The mathematical method of discrete Fourier transformation may be employed to convert the transient in the time domain (e.g., curve 22 in FIG. 2B), which comprises the mixture of periodic transient signals which result from the mixture of m/z present among the measured ions, into a spectrum in the frequency domain. If desired, at this stage or later, the frequency domain spectrum can be converted into the m/z domain by straightforward calculation. The discrete Fourier transformation produces a spectrum which has a profile point for each frequency or m/z value, and these profile points form a peak at those frequency or m/z positions where an ion signal is detected (i.e. where an ion of corresponding m/z is present in the analyzer).

Mathematically, the Fourier transform outputs a complex number for each profile point (frequency). The complex number comprises a magnitude and a phase angle (often simply termed phase). Alternatively, the complex number at each frequency point may be described as comprising a real component, Re, and an imaginary component, Im. Together, the set of real components, Re, and imaginary components, Im, compose a so-called complex spectrum. It is generally the case that the real component and imaginary component are asymmetrical because the initial phase of the signal at the start of the transient is not zero. Because asymmetrical peaks lead to undesirable low spectral resolution, conventional Fourier transform processing of mass spectral transients has made use of the so-called magnitude spectrum rather than a spectrum based on the real or imaginary components alone. Therefore, in conventional Fourier transform processing of the electrostatic trap transient signal, the phase angle information has often been ignored. To improve the resolution of mass spectra, U.S. Pat. No. 8,853,620 in the name of inventor Lange teaches the generation of enhanced mass spectra that are calculated, after the Fourier-transform generation of real and imaginary complex spectral components, through the combination of a so-called "positive spectrum" (which, in many cases, may be any of a Power spectrum, a Magnitude spectrum or estimates thereof) together with an "absorption spectrum", which is the real or imaginary component of the complex spectrum after application of an appropriate phase correction that causes the corrected phase to be zero at a peak center.

Regardless of the level of sophistication of the mathematical processing that is employed to convert measured transient signals into mass spectra, the mass resolving power of an electrostatic orbital trapping mass analyzer of the type illustrated in FIGS. 1A-1B or any other electrostatic trapping mass analyzer may be inhibited by accumulation of space charge within the trap. Like any ion trap mass analyzer, there is a finite amount of charge that may be injected into an electrostatic orbital trapping mass analyzer of the type illustrated in FIGS. 1A-1B while still attaining a given level of performance. In a very general sense, the buildup of charge density within a trap produces perturbations of the electric field within the measurement cavity 17 that causes local deviations of the form of the field from the theoretical form given by Eq. 1. More specifically, interactions between ions that are caused by increase in the density of space charge may lead to ion-to-ion transfers of both momentum and energy between ion species of differing m/z ratios. A transfer of momentum may cause disruption of the z-axis oscillatory phase coherence among ions of the same ink value thereby leading to broadened and weakened transient signals, coalescence of mass spectral peaks and consequent loss of spectral resolution. A transfer of energy may cause some ions to prematurely collide with one or the other of the electrodes, thereby contributing to a loss of signal.

The geometric configuration of electrodes within the electrostatic trap mass analyzer illustrated in FIGS. 1A, 1B is more favorable to dispersal of space charge than is three-dimensional radio frequency (RF) quadrupole ion trap. This is because, in the mass analyzer shown in FIGS. 1A, 1B, ions of each ink value are partially angularly dispersed, in the form of an arc, around the spindle electrode 6 within the measurement cavity 17 instead of being confined to a localized central volume (as in a multipole ion trap). Nonetheless, the space charge dispersal parallel to the z-axis is limited, because the z-axis oscillatory amplitude of all ink species is approximately the same, as schematically indicated by cylinder 36 in FIG. 3A. This phenomenon can lead to unacceptably high ion density at the z-axis oscillation extrema, where motion parallel to the z-axis reverses direction for all ions. The accumulated ion density at these "turn-around" zones can lead to situations in which ion species with nearly identical ink ratios move synchronously, thereby leading to peak coalescence in the resulting mass spectra and consequent loss of mass spectral resolution. Many advanced analytical applications require both high resolving power and high signal-to-noise ratios. Therefore, the inventors have recognized a need to improve these performance characteristics, inasmuch as they pertain to some electrostatic traps, by utilizing the available electrostatic trapping volume in a manner that reduces localized accumulation of ion density within the trapping volume. The present invention addresses these needs.

SUMMARY OF THE INVENTION

In accordance with the present teachings, methods are provided in which ions are spread programmatically along the available trap z-axis amplitude according to their intact mass-to-charge (m/z) ratios to minimize temporal overlap of all ions and reduce accumulation of ion density at the z-axis oscillation extrema. The present invention thus provides a planned utilization of available trap volume to minimize space-charge and ion-ion interaction for the duration of the trapping and detection of ions within the ORBITRAP™ mass analyzer. Programming of z-axis amplitude has been found to provide a significant performance enhancement of an electrostatic orbital trapping mass analyzer of the type illustrated in FIGS. 1A-1B and may be applicable to other three-dimensional electrostatic trap apparatuses. One other major class of three-dimensional electrostatic trap apparatuses is represented by the various so-called Cassinian electrostatic ion trap apparatuses (also referred to as "Cassinian trap" apparatuses) as described in U.S. Pat. No. 7,994,473 in the name of inventor Köster, said patent hereby incorporated herein by reference in its entirety. Whereas an ORBITRAP™ mass analyzer employs an electrostatic trap comprising an outer electrode and a single inner spindle electrode, the Cassinian trap apparatus employs an outer electrode and two or more inner spindle electrodes. Therefore, the various Cassinian trap apparatuses and their derivatives may be collectively referred to as "Higher-Order Kingdon" trap apparatuses.

In accordance with some embodiments of the invention, ions are provided to the electrostatic trap and an initial transient signal is recorded and analyzed according to the method of enhanced Fourier Transformation (eFT) so as to recover phase information associated with various frequencies of oscillatory components of the transient, where each oscillatory component pertains to a respective m/z ratio. Phase information could also be derived from other methods of so-called "phasing" wherein phase information is recovered during the transformation process. The derived phase information is then used during the programmed application of a supplemental AC multi-frequency waveform to the outer electrodes of the electrostatic trap during which, in accordance with the programming, oscillations corresponding to various m/z ratios are either enhanced (excited) to higher energy or damped (de-excited) to lower energy. The application of the supplemental or auxiliary multi-frequency waveform superimposes a multi-frequency oscillatory modulation field onto the main trapping electrostatic field within the trapping region, wherein the modulation field acts to either increase or reduce the harmonic motion energies of the ions by an amount varying according to the frequency of harmonic motion. To provide appropriate excitation and de-excitation, the supplemental AC waveform varies in frequency and amplitude according to the z-axis oscillation frequency of each m/z ratio. Also, the various supplemental AC frequencies may be applied in-phase with the ions z-axis oscillations according to the phase information derived from the prior eFT analysis or, in general, in accordance with phase analysis derived by other mathematical transform techniques.

The excitation of oscillations produces a wider z-axis oscillation range for those ions that are excited; the de-excitation produces a narrower z-axis oscillation range for those ions that are de-excited. The average orbital radius of ions around the z-axis may also respectively increase or decrease concurrently. This programmatic control of oscillation amplitude and possibly orbital radius more efficiently spreads ion charge throughout more of the available trapping volume, thereby negating the deleterious effects of accumulation of space charge density within the trapping volume.

According to one aspect of the invention, a method of operating an electrostatic trapping mass analyzer is provided, the method comprising: introducing a sample of ions into a trapping region of the mass analyzer, wherein a trapping field within the trapping region is such that the ions exhibit radial motion with respect to a central longitudinal axis of the trapping region while undergoing harmonic motion in a dimension defined by the central longitudinal axis, the frequency of harmonic motion of a particular ion being a function of its mass-to-charge ratio; superimposing a modulation field, which may be a periodic modulation field, a multi-frequency modulation field or a simple impulse, onto the trapping field within the trapping region, the modulation field acting to either increase or reduce the harmonic motion amplitudes of the ions by an amount varying according to the frequency of harmonic motion; and acquiring a mass spectrum of the ions in the trapping region by measuring a signal representative of an image current induced by the harmonic motion of the ions.

BRIEF DESCRIPTION OF THE DRAWINGS

The above noted and various other aspects of the present invention will become apparent from the following description which is given by way of example only and with reference to the accompanying drawings, not drawn to scale, in which.

DETAILED DESCRIPTION

The following description is presented to enable any person skilled in the art to make and use the invention, and is provided in the context of a particular application and its requirements. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described. The particular features and advantages of the invention will become more apparent with reference to the appended figures taken in conjunction with the following description.

Figure 1A:
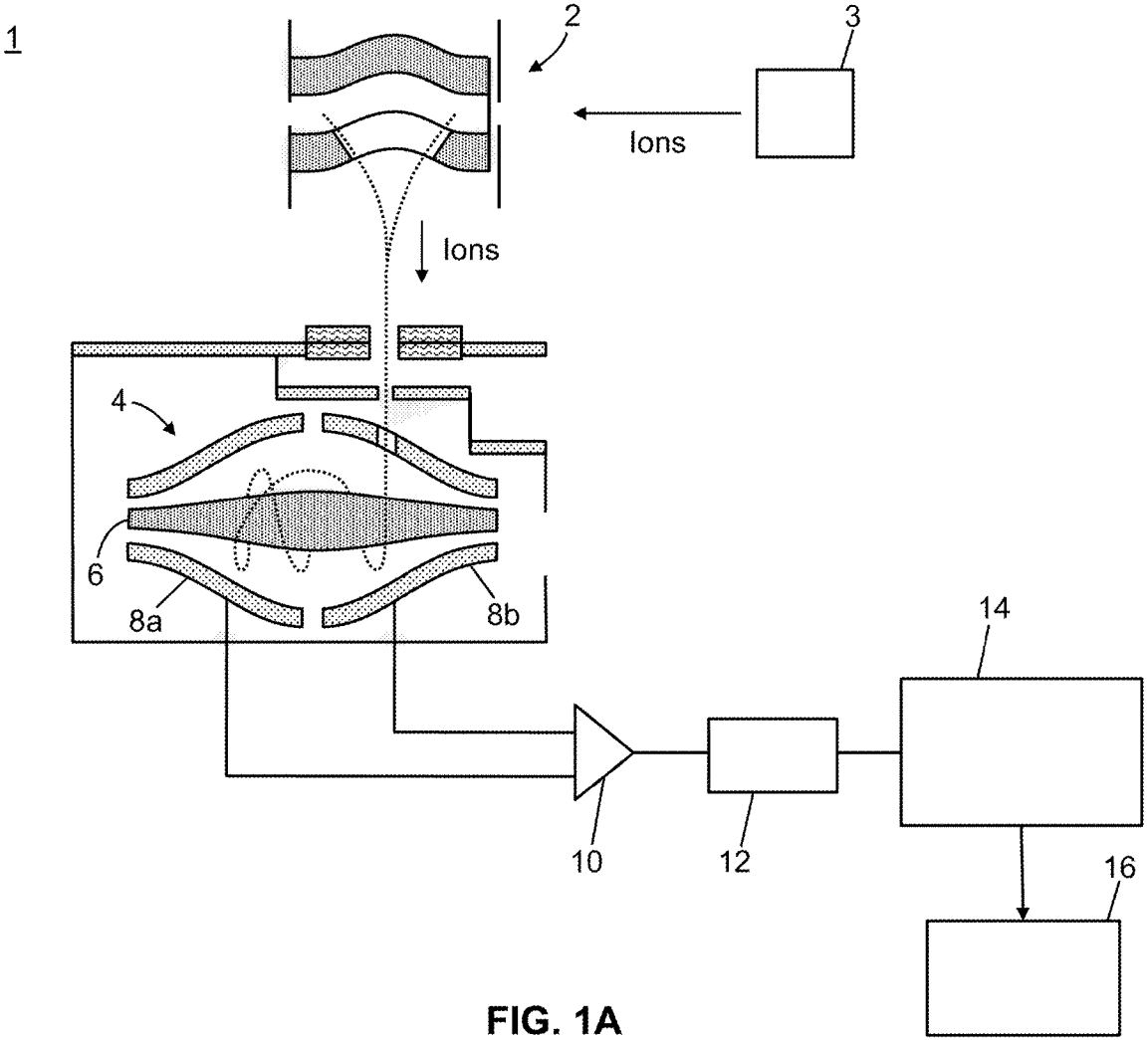
FIG. 1A is a schematic depiction of a portion of a mass spectrometer system including an electrostatic trap mass analyzer, specifically an ORBITRAP™ electrostatic trap mass analyzer.
Figure 1B:
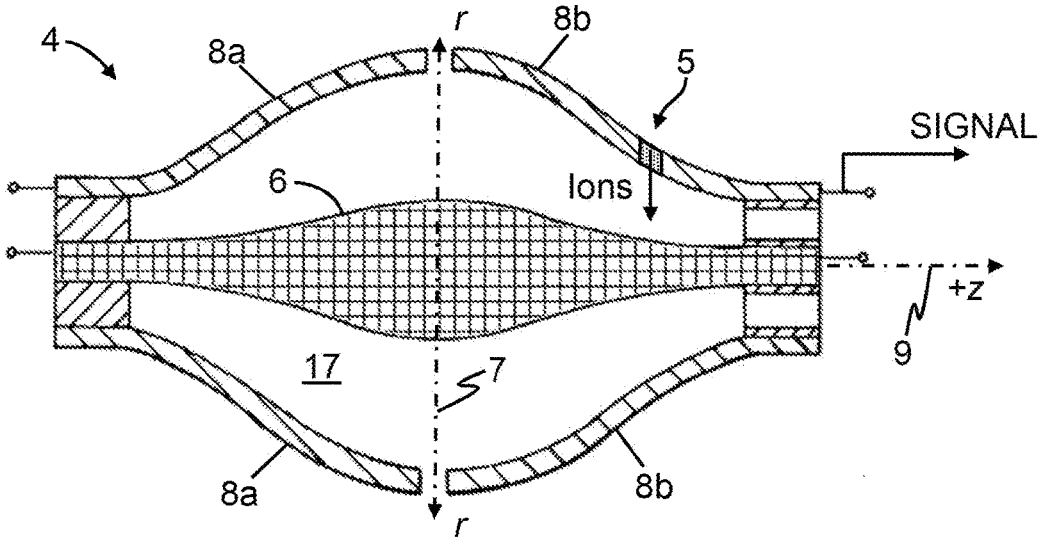
FIG. 1B is an enlarged cross sectional view of the electrostatic trap mass analyzer of FIG. 1A.
Figure 2A:
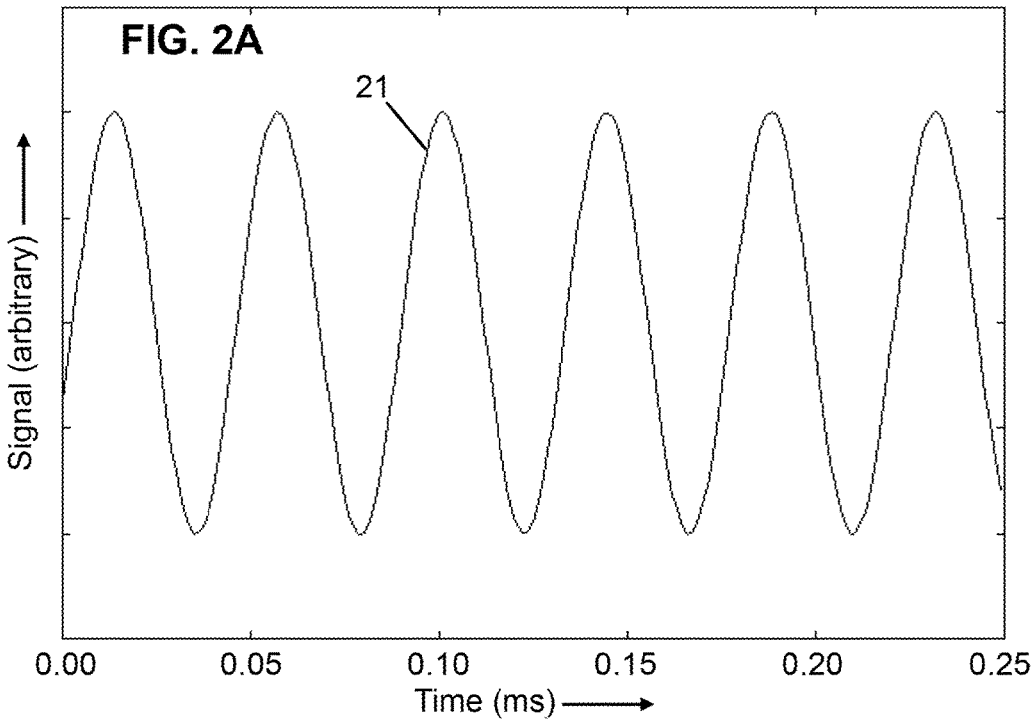
FIG. 2A is a depiction of an "ideal" transient for just a few oscillations of a single frequency component, relating to ions of a particular mass-to-charge (m/z) ratio, as may be measured during operation of the electrostatic trap mass analyzer of FIG. 1A.
Figure 2B:
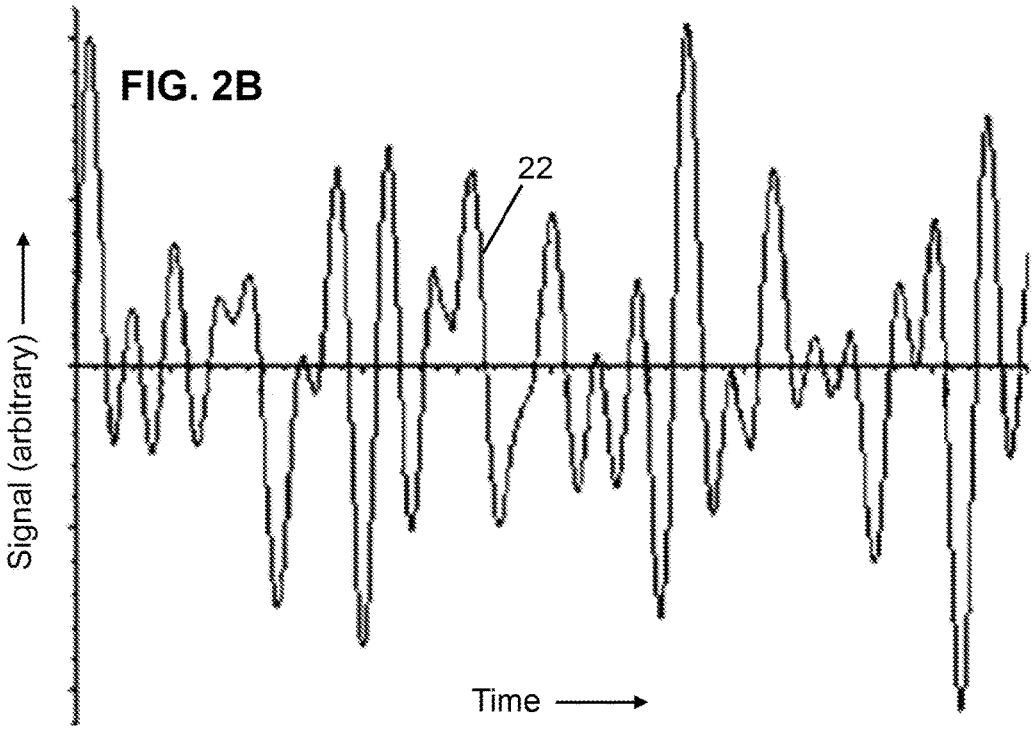
FIG. 2B is a depiction of a transient for just a few oscillations of a limited number of frequency components, relating to respective different m/z ratios, as may be measured during operation of the electrostatic trap mass analyzer of FIG. 1A.
Figure 3A:
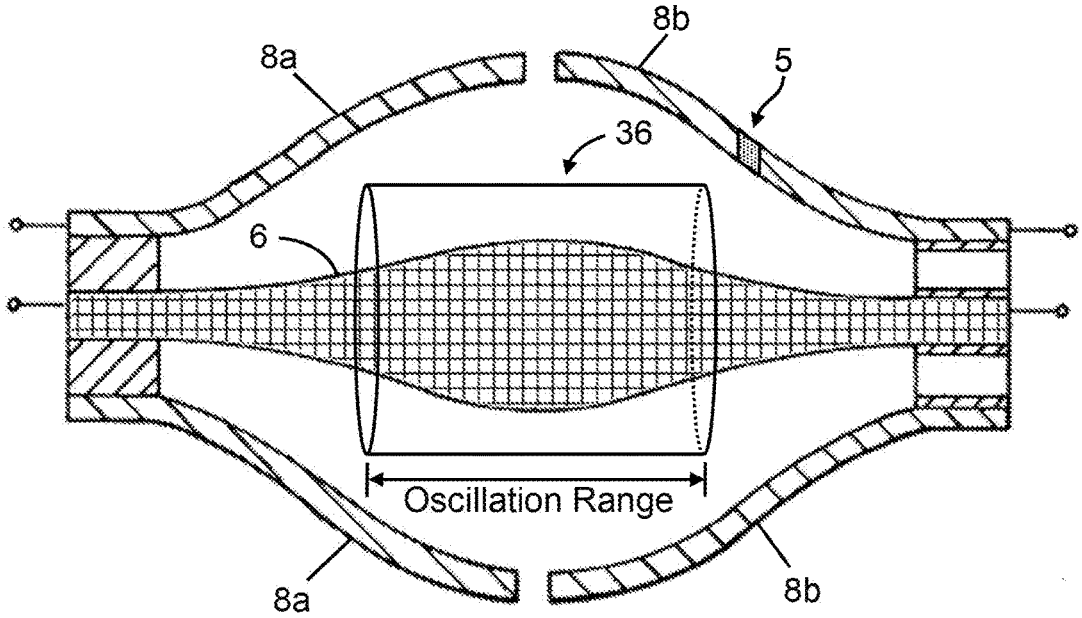
FIG. 3A is a schematic depiction of a range of axial oscillation of ions of various m/z ratios within a conventionally-operated electrostatic trap mass analyzer of the type depicted in FIG. 1A and FIG. 1B.

During operation of the mass analyzer 4 shown in FIGS. 1A and 1B, ion injection is presently performed using a fixed ion injection schema, whereby the entry point of ions into the trap is at an ion injection aperture 5 that is offset from the equatorial plane 7 of the trap. With such a configuration, the z-displacement of the injection aperture determines the z-axis oscillation amplitude of all ions which enter and maintain stable orbits. The axial motion of all trapped m/z species thus possess similar z-axis oscillation amplitudes, whereby space charge and ion-ion interactions are non-ideal and contribute negatively to performance aspects such as dynamic range, isotope peak ratio, and peak coalescence. In FIG. 3A, the post-injection z-axis ion oscillation range for essentially all ions (of essentially all m/z ratios) is illustrated by cylinder 36 (note that the cylindrical representation is schematic only—the zone of occupation of ions of any m/z ratio is more complex than that of a cylindrical surface). The inventors have realized that this conventional mode of operation leads to inefficient use of available trap volume and consequent inhomogeneous space charge density within the electrostatic trap.

Early literature (e.g., U.S. Pat. No. 5,886, 346 and Makarov, Electrostatic Axially Harmonic Orbital Trapping: A High-Performance Technique of Mass Analysis, Anal. Chem., 72(6), 2000, pp. 1156-1162) pertaining to ORBITRAP™ mass analyzers having a configuration as schematically illustrated in FIGS. 1A and 1B described so-called "Mass-Selective Instability" (MSI) modes of operation.

According to a first MSI mode, termed "Parametric Resonance", a supplemental RF sinusoidal voltage is applied between the inner electrode 6 and the outer electrodes 8*a*, 8*b*. In this mode of operation, the equations describing z-axis ion motion within the trap are the well-known Mathieu equations. In an alternative MSI mode, termed "Resonant Excitation", a supplemental sinusoidal voltage is applied to one of the two outer electrode halves 8*a*, 8*b* at the resonant axial frequency of a particular mass whose axial motion is to be excited. In similarity to the parametric resonance MSI method, such resonantly excited ions are ejected axially.

In U.S. Pat. No. 6,872,938 in the names of inventors Makarov et al., said patent hereby incorporated by reference herein, the concepts of parametric resonance and resonance excitation were extended to include ion excitation without ejection as well as de-excitation. According to the teachings of U.S. Pat. No. 6,872,938, fragment ions generated by the process of metastable dissociation (MSD) may be analyzed in an electrostatic trap mass analyzer using de-excitation followed by subsequent excitation. The energetic precursor ions from which the fragments are produced are activated prior to injection into the electrostatic trap and subsequently allowed to dissociate within the electrostatic trap. Prior to the dissociation, the axial motion of the precursor ions is selectively de-excited by application of a supplemental sinusoidal voltage waveform at an appropriate frequency, such as double the frequency of the undamped axial oscillations of the precursor ions. Typically, the supplemental waveform comprises a radio-frequency (RF) waveform. The application of the supplemental sinusoidal voltage decreases the amplitude of axial oscillation of selected ions so that only selected precursor ions are brought onto and restricted to the equatorial plane 7 of the ion trap. The precursor ions are left in this state long enough to allow metastable decay to occur. The z-axis oscillations of the remaining precursor ions as well as of any fragment ions generated by MSD are then excited by application of a broadband supplemental waveform.

The aforementioned techniques of parametric resonance and resonance excitation were described for the purposes of mass spectral scanning by resonant ejection or detection of fragment ions produced by dissociation within an electrostatic trap. Because mass spectral scanning and ion fragmentation are readily performed with other apparatuses, these techniques of parametric resonance and resonance excitation have not been extensively employed in the operation of electrostatic trap mass analyzers. However, the present inventors have realized that the Resonant Excitation and De-Excitation techniques may be employed to advantage so as to at least partially separate the ion occupation regions of ions of differing m/z ratios, thereby reducing localized buildup of charge density within the trap. The reduction of ion density is especially effective at the z-axis oscillation extrema, because these z-axis oscillation extrema are caused to be dispersed along the z-axis according to m/z. Accordingly, the available trap volume is utilized more efficiently through the re-distribution of ion density.

Figure 4A:
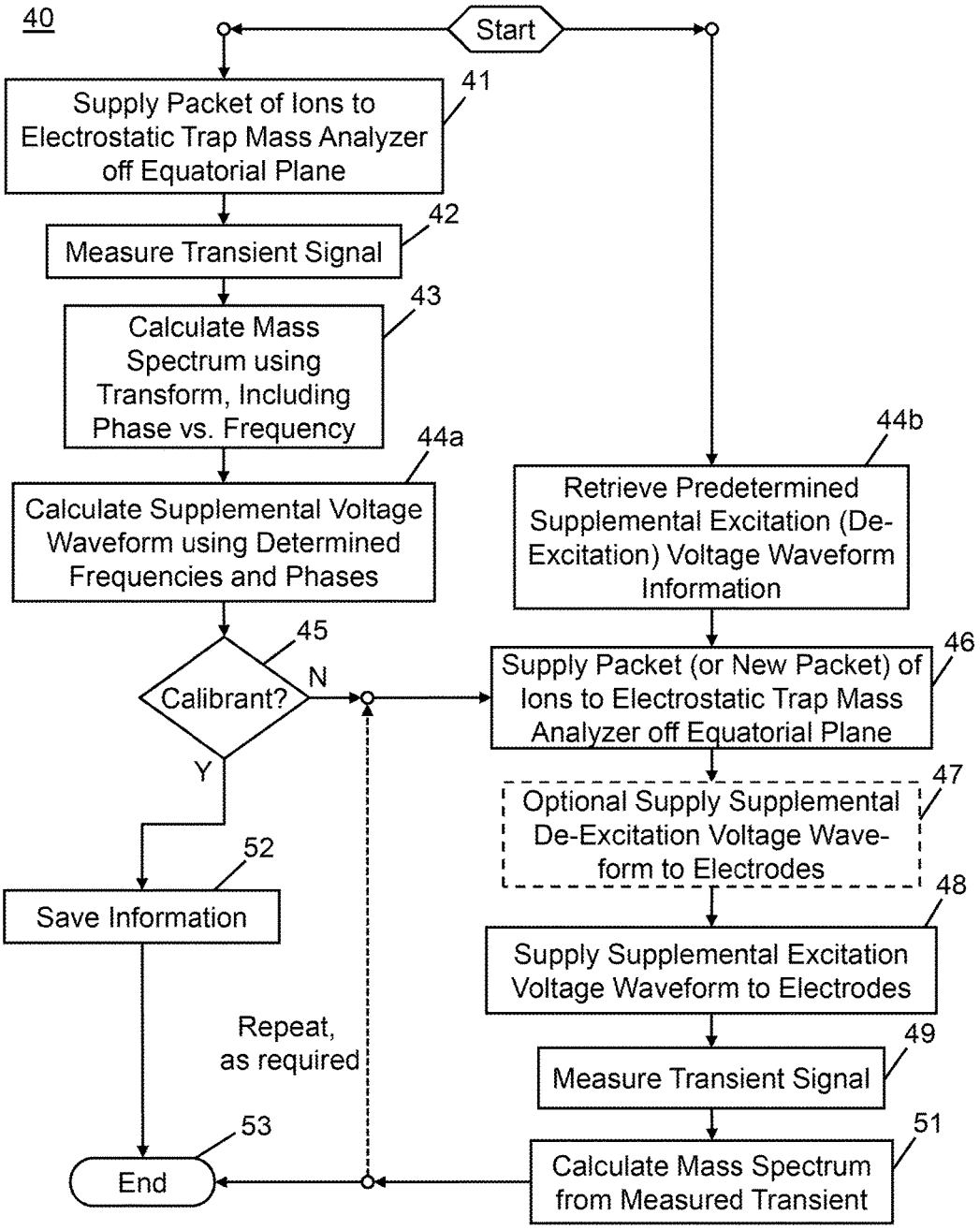
FIG. 4A is a flow diagram of a first method of operation of an electrostatic trap mass analyzer in in accordance with the present teachings.

In view of the above observations, FIG. 4A is a flow diagram of a method 40 for operating an electrostatic trap mass analyzer within a mass spectrometer system in accordance with the present teachings. If the form of a supplemental excitation (or de-excitation) voltage waveform may be simply calculated or is already known, as from a prior experiment, then execution of the method 40 may begin at Step 44*b*, at which the voltage waveform may be calculated or the predetermined or previously stored information relating to the voltage waveform may be retrieved. Otherwise, execution of the method 40 may begin at Step 41. If predetermined or previously stored information is retrieved at Step 44*b*, such information may have been derived by a prior execution of the method 40 in which the prior sample of ions is a set of calibrant ions. If a supplemental voltage excitation waveform is calculated at Step 44*b*, the waveform may, in some cases, be calculated as a multi-frequency voltage waveform of which the frequencies or amplitudes (or both) of the various periodic components are chosen as appropriate from a selected range of frequencies and a selected range of amplitudes, respectively. For example, the selected range of frequencies (from which frequencies are chosen for inclusion in the supplemental multi-frequency waveform) may correspond to a range of m/z ratios to be detected in a particular experiment.

In step 41 of the method 40, a first packet of ions is supplied to the electrostatic trap mass analyzer through an aperture (e.g., aperture 5) that is displaced from the equatorial plane of the trap. The ions may be produced by any known ionization technique, such as by thermospray ionization, electrospray ionization, electron ionization, chemical ionization, matrix-assisted laser desorption ionization, photo-induced ionization, etc. The ionization may be performed by an ion source component of the mass spectrometer system. Prior to injection, a population of ions may be accumulated within an accumulation ion trap component of the mass spectrometer system. At least some of the accumulated ions are then provided to the electrostatic trap as a packet that is tightly bunched spatially and temporally through application of a voltage pulse that releases the accumulated ions as the packet. The ion injection into the electrostatic trap is performed through an ion injection aperture that is offset from an equatorial symmetry plane of the electrostatic trap such that ion oscillation within the electrostatic trap begins immediately upon injection (that is, according to the so-called "excitation by injection" technique).

In the subsequent step 42 of the method 40 (FIG. 4A), the ions of the ion packet of various m/z ratios are allowed to oscillate within the electrostatic ion trap and an image current that tracks the combined ion oscillations of all ion species is measured by detection electrodes and recorded as a transient signal in known fashion. In Step 43, a preliminary mass spectrum is calculated from the measured and recorded transient signal using the enhanced Fourier Transform (eFT) method as taught in U.S. Pat. No. 8,853,620 or, alternatively, any equivalent mathematical method. According to the eFT method, a Fourier transform is first calculated in a conventional way (such as by a Fast-Fourier transform) so as to generate real and imaginary complex spectral components in the frequency domain. Subsequently a frequency spectrum (or a mass spectrum, through a simple transformation of variables) is calculated as a combination of a so-called "positive spectrum" (which, in many cases, may be any of a Power spectrum, a Magnitude spectrum or estimates thereof) together with an "absorption spectrum", which is the real component of the complex spectrum after application of an appropriate phase correction that causes the corrected phase to be zero at a peak center. The derived frequency spectrum (or the mass spectrum) generally comprises a plurality of peaks, where the location of each such peak in the frequency domain provides information about a frequency of oscillation, within the electrostatic trap, of an ion species of a respective m/z ratio. The determined phase corrections provide information about the relative phase offsets between the oscillations of the various ion species (corresponding to respective peaks in the frequency spectrum) and by inference the functional dependence of phase with frequency (and thus m/z).

In the subsequent Step 44*a*, of the method 40 (FIG. 4A), the phase and frequency information derived in the prior step 43 is used to calculate the frequencies of a supplemental or auxiliary periodic voltage waveform to be applied to the electrodes of the electrostatic trap (for instance, in a later Step 48). The supplemental or auxiliary voltage waveform may consist of a set of superimposed (multiplexed) component periodic waveforms, each component waveform comprising a respective periodic waveform of a frequency that corresponds to the frequency of oscillation (generally, a frequency of a z-axis oscillation as described above) of an ion species of a respective m/z ratio. Each waveform component frequency is related to the oscillation frequency of the ion species to which it corresponds. The waveform component frequency and the ion species oscillation frequency may be identical; however, in some instances the waveform component frequency may be an integral multiple or very close to an integral multiple of the ion species oscillation frequency such as, for example, twice the ion oscillation frequency. The phase of each waveform component may be such that when applied the periodic oscillations of the voltage waveform component add to the ion motion primarily "in phase" with the oscillations of the corresponding ion species; however, some other pre-determined phase relationship between the ion oscillation and the waveform component may be employed. The waveform component phases may be determined from the phase information generated in step 43. The amplitude of each waveform component corresponds to a degree of excitation or de-excitation to be applied to the oscillations of the corresponding ion species. According to some embodiments, an excitation waveform may not be periodic and may, instead comprise a simple impulse, since an impulse may be considered to comprise a continuous range of component frequencies that may excite oscillations of ions comprising a plurality of m/z values. In such instances, the step 44*a* may be skipped.

If it is not possible or difficult to multiplex the various waveform components as described above, then each waveform component may be applied within its own respective time segment. The waveform components would then be applied sequentially instead of in a superimposed fashion. In this alternative type of operation, each waveform component is applied to the electrodes at a certain respective segment application time. Each such segment application time is determined such that the phase of the applied periodic waveform component is related to the phase of the oscillations of the corresponding ion species. In general, each segment application time is such that the applied waveform component of the segment is "in phase" with the oscillations of the corresponding ion species; however, some other pre-determined phase relationship between the ion oscillation and the waveform component may be employed. In this alternative mode of operation, the waveform segment application times may be determined from the phase information generated in step 43.

If (Step 45) a particular execution of the method 40 pertains to a calibration experiment, possibly using a sample including calibrant compounds, then the supplemental voltage waveform information generated in Step 43 may be saved for use in later analyses (Step 52) and the method may terminate at Step 53. Otherwise, execution may proceed to Step 46 at which a new packet of ions from the same general ion population as the first ion packet is injected into the electrostatic trap. The time of the injection is set as "time zero" (t=0, denoted $t_0$) for determination of phase offsets to be applied during subsequent provision of a supplemental or auxiliary voltage waveform to the trap electrodes in a later Step 48. This second injection is performed in the same manner as the first injection (step 41).

In optional Step 47 of the method 40 (FIG. 4A), a supplemental or auxiliary broadband de-excitation voltage waveform is applied to the electrodes of the electrostatic trap mass analyzer in order to fully de-excite the z-axis oscillations of all ions to a known starting state in which the ions are temporarily confined to the equatorial plane. This step is then followed by subsequent excitation of z-axis oscillations to a desired oscillation amplitude profile (in Step 48) using the calculated supplemental excitation voltage waveform (Step 44*a*) or the pre-determined supplemental excitation voltage waveform (Step 44*b*) or, alternatively, a simple impulse function. The desired oscillation amplitude profile is one which reduces overall charge density within the trap so as to improve trap performance and the quality of mass spectra obtained from the trap. Each component of the voltage waveform serves to either excite the z-axis oscillations of the ion species that are close in frequency to a higher amplitude or, alternatively, "de-excite" the z-axis oscillations of only the ion species that are close in frequency to a lower amplitude. Such de-excitation only applies if the prior optional broadband de-excitation step (Step 47) has not been executed. The closer in frequency a component of the voltage waveform is to that of any particular m/z the stronger the coupling effect to the motion of that m/z. However all applied waveform frequency components couple to the motion of all ions to greater or lesser extent.

The application of excitation waveforms for excitation of an ion species to a higher average kinetic energy level expands the z-axis oscillation range of the ion species and may also increase or decrease the average radius of orbits around the spindle electrode. Conversely, the application of excitation waveforms to effect de-excitation reduces the z-axis oscillation range of the ion species and may also decrease or increase the average orbital radius for that ion species. Further, application of such excitation and de-excitation waveforms may also increase or decrease the spread in orbital radii around the average orbital radius for that species. Excitation may be achieved by applying the voltage waveform component so as to be of the same frequency as and in phase quadrature with the oscillations of the corresponding ion species; de-excitation may be achieved by applying the voltage waveform component with some other phase or frequency relationship relative to the ion species oscillations, such as out of phase, in phase quadrature with or at twice the ion oscillation frequency.

Figure 3B:
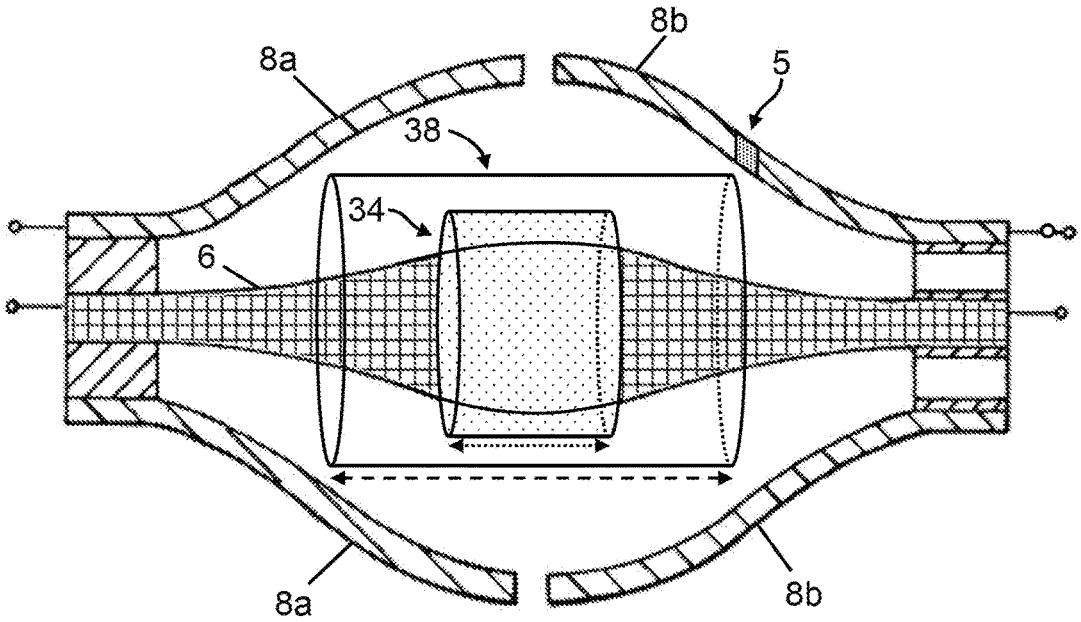
FIG. 3B is a schematic depiction of the ranges of axial oscillation of ions of two respective different m/z ratios within an electrostatic trap mass analyzer of the type depicted in FIG. 1A and FIG. 1B operated in accordance with the present teachings.

Now referring to FIG. 3B, there is shown a schematic depiction of the ranges of axial oscillation of ions of two respective different m/z ratios within an electrostatic trap mass analyzer of the type illustrated in FIG. 1A and FIG. 1B and operated in accordance with the present teachings. In FIG. 3B only the extrema are represented in terms of the highest m/z (represented as cylinder 38) and lowest m/z (represented as cylinder 34) observed in the broad band spectrum. Spreading of the z-amplitude maxima as a function of m/z is found to decrease localized buildup of space charge density within the trap volume, especially at the z-axis oscillation extrema which would otherwise be nearly coincident for all ions. The dispersal of the oscillation amplitudes provided by the application of the supplemental waveform improves the quality of the resulting spectra.

Figure 5A:
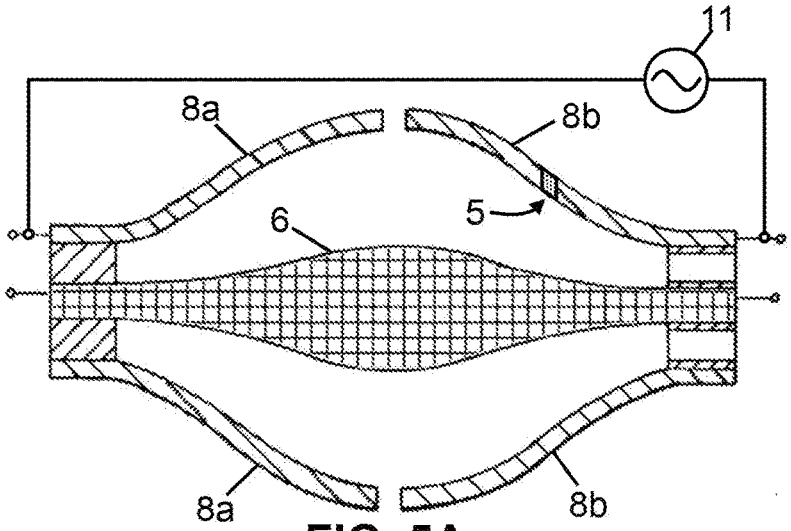
FIG. 5A is a schematic illustration of a first configuration of electrical connections of a supplemental waveform generator to an electrostatic trap, in accordance with some embodiments of the present teachings.
Figure 5B:
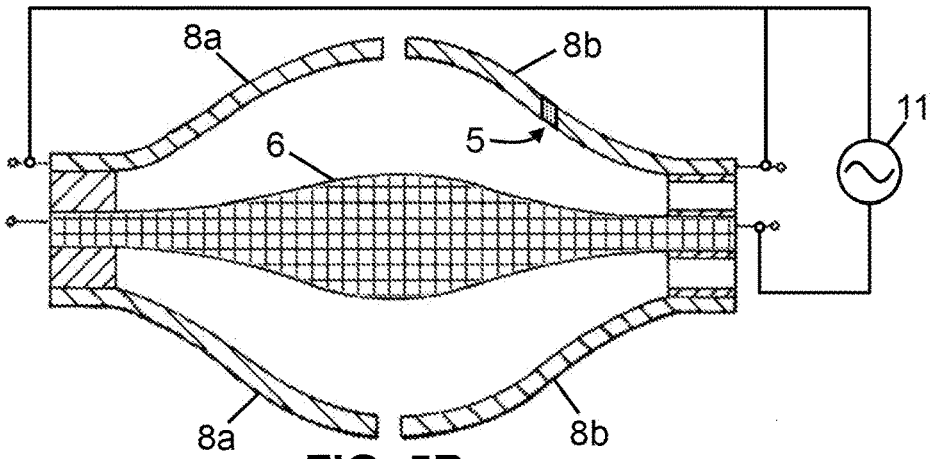
FIG. 5B is a schematic illustration of a second configuration of electrical connections of a supplemental waveform generator to an electrostatic trap, in accordance with some embodiments of the present teachings.
Figure 5C:
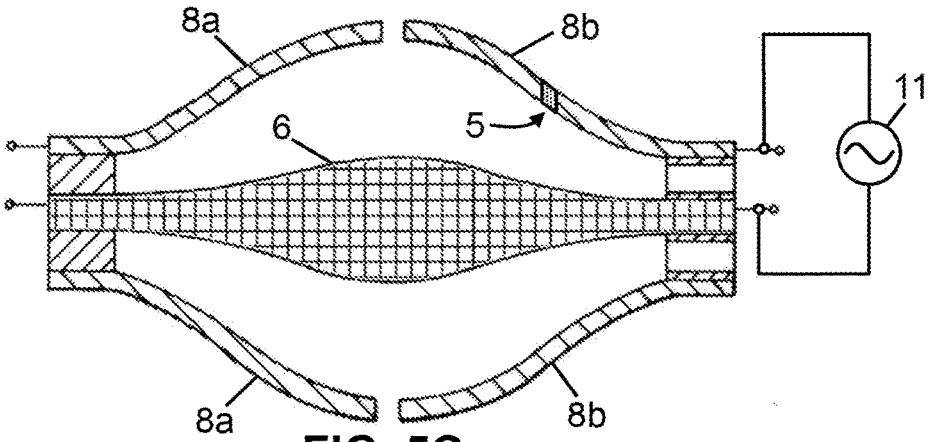
FIG. 5C is a schematic illustration of a second configuration of electrical connections of a supplemental waveform generator to an electrostatic trap, in accordance with some embodiments of the present teachings.

The supplemental or auxiliary field may be applied to the electrodes in a variety of ways, as illustrated in FIGS. 5A, 5B and 5C. In each of FIGS. 5A-5C, element 11 is a voltage waveform source that may include various electronic and electrical components such as a digital waveform generator, a power supply, an amplifier, etc. Other electrical components, such as the power supply and controller that maintains and controls the DC voltage difference between inner and outer electrodes, the components that measure image current, etc. are not illustrated in FIGS. 5A-5C. It should also be noted that, in each of these figures, each of electrodes 8*a* and 8*b* is cylindrically symmetrical in three dimensions and, thus, each such electrode is formed of a single piece (i.e., not two pieces). In FIG. 5A, the supplemental or auxiliary voltage is supplied across the two outer electrodes 8*a*, 8*b*, a configuration which is expected to primarily resonantly excite axial (z-axis) oscillations as previously noted. In FIG. 5B, the supplemental or auxiliary voltage is applied between the inner spindle electrode 6 and the pair of outer electrodes 8*a*, 8*b*, a configuration which is also expected to resonantly excite axial oscillations as well as to radially disperse ions according to m/z. In FIG. 5C, the supplemental or auxiliary voltage is applied between the inner spindle electrode 6 and just one of the outer electrodes, either electrode 8*a* or electrode 8*b*.

Returning to the discussion of the method 40 of FIG. 4A, Step 49 is another transient signal measurement and recording step, similar to the preceding Step 42 except that, in the Step 49, the measurement is made of ion oscillations that correspond to a more favorable dispersal of the ions throughout the trapping volume, as provided by the application of the supplemental or auxiliary waveform in step 49. Subsequently, a final mass spectrum is calculated in Step 51, using any suitable transformation or calculation technique but, preferably, using the enhanced Fourier Transform technique noted above. The mass spectrum calculated in Step 51 may regarded as a refined mass spectrum, relative to the preliminary mass spectrum calculated in Step 43. Steps 46 through 51 may be repeated, using respective packets of ions, as may be required. Amplitudes of the reported m/z peaks in the calculated spectra m/z may be adjusted according (generally inversely) to their corresponding z-axis oscillation amplitude so that that different m/z peaks produced by the same amount of ion net charge have the same or nearly the same amplitudes.

Figure 4B:
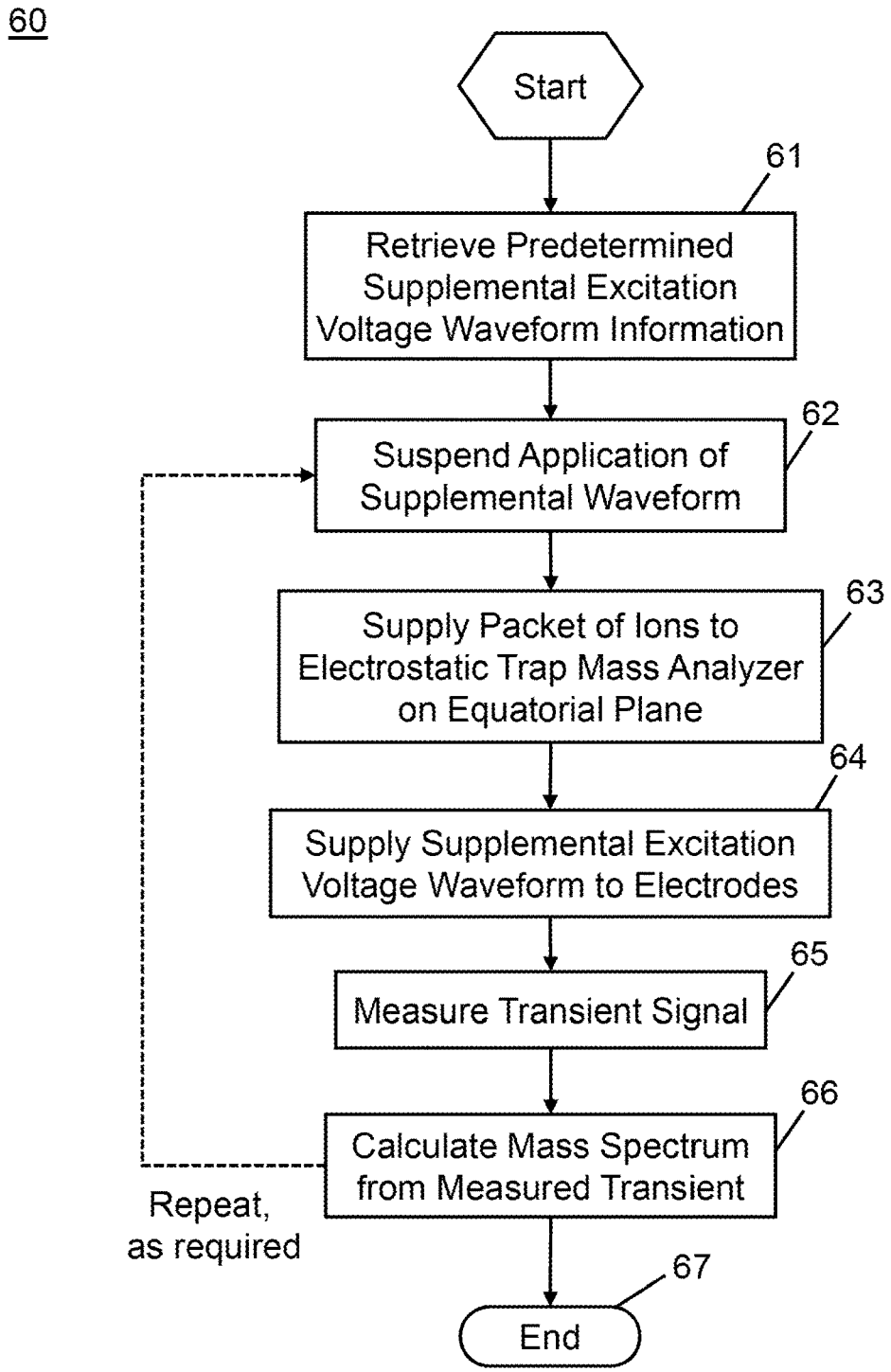
FIG. 4B is a flow diagram of a second method of operation of an electrostatic trap mass analyzer in in accordance with the present teachings.

FIG. 4B is a flow diagram of a second method, method 60, for operating an electrostatic trap in accordance with the present teachings. The method 60 (FIG. 4B) applies to injection of ions on the equatorial plane 7 of an electrostatic trap 4 (see FIG. 1B) as opposed to the previously described method 40 (FIG. 4A) which applies to ion injection through an aperture (e.g., aperture 5) that is displaced from the equatorial plane. In Step 61, a pre-determined supplemental excitation waveform is retrieved. According to some embodiments, the excitation waveform may be periodic and may comprise a set of periodic components of respective frequencies. According to some other embodiments, an excitation waveform may not be periodic and may, instead comprise a simple impulse, since an impulse may be considered to comprise a continuous range of component frequencies that may excite oscillations of ions comprising a plurality of m/z values. In such latter instances, the step 61 may be skipped. In Step 62, the application of any prior supplemental waveform is suspended. In Step 63, a packet of ions is introduced into the electrostatic trap on the equatorial plane of the trap. Because the equatorial plane effectively defines the bottom of the harmonic potential well with regard to z-axis oscillations, all injected ions take up temporary residence in orbits about the spindle electrode 6 within the equatorial plane. Next, in Step 64, a supplemental excitation waveform is applied, as described previously, such that the various ions develop oscillatory motion along the z-axis with different z-axis oscillation extrema as a function of their respective frequencies and m/z ratios. In Step 65, a transient signal is measured and in Step 66, a mass spectrum is calculated, using the transient information in known fashion. Steps 62-66 may then be repeated as many times as necessary in order to repeat mass spectral analysis of a given sample composition or to perform mass spectral analyses of differing sample compositions.

In the above, the present invention has been described with reference to an ORBITRAP™ mass analyzer which is schematically illustrated in FIGS. 1A-1B. The present invention is also applicable to operation of other forms of electrostatic trap mass analyzer within which ions undergo mathematically orthogonal components of oscillatory motion and wherein the frequency of oscillation of at least one such component is independent of the other oscillation components. For example, the present invention is also applicable to operation of Higher-Order Kingdon traps, as described above, which include Cassinian electrostatic ion trap mass analyzers.

Generally stated, a Cassinian electrostatic ion trap comprises an outer electrode with an ion-repelling electric potential and at least two inner electrodes with ion-attracting potentials, where the outer electrode and the inner electrodes are shaped and arranged in such a way that a harmonic electric potential is formed in one spatial direction and, perpendicular to this spatial direction, an electric potential is formed in which ions move on stable, radial trajectories. For example, a known Cassinian electrostatic ion trap, as described in U.S. Pat. No. 7,994,473, comprises an outer electrode maintained at a first electrical potential and two spindle-shaped inner electrodes both maintained at a same second electrical potential. Together, the outer electrode and inner spindle electrodes generate an electric potential, U, between the electrodes that takes the form of Eq. 4:

$$U(x, y, z) = U_0 + U_C \ln\left[\frac{(x^2+y^2)^2 - 2b^2(x^2-y^2) + b^4}{a^4}\right] - \frac{k}{2}(x^2+y^2) + kz^2 \quad \text{Eq. 4}$$

where, x, y and z are Cartesian coordinates, $U_0$ is an offset of the potential that is proportional to the voltage between the outer electrode and the inner electrodes, $U_C$ is a scaling factor, and where a, b and k are parameters (constants). The outer electrode and the two spindle-shaped inner electrodes are shaped and arranged such that the inner surface of the outer electrode and the surfaces of the spindle-shaped inner electrodes each correspond to equipotential surfaces of the above electric potential. Accordingly, each spindle electrode is shaped with a diameter that is greatest at its central region and that tapers towards each end. The parameters a and b are related to the radial geometry of the electrode system. The parameter b, which is non-zero, corresponds to the distance between the axis of each spindle and the central z-axis. The parameter k determines the harmonic motion of the ions along the z-axis and is also proportional to the voltage between the outer electrode and the inner electrodes. Specifically, The parameter k, the ion mass m, and the charge z of the ion determine the oscillation frequency ω of the harmonic oscillation along the z-direction:

$$\omega = \sqrt{\frac{2k}{m/z}} \quad \text{Eq. 5}$$

As noted in the aforementioned U.S. Pat. No. 7,994,473, one way to obtain mass-dependent data from such a Cassinian electrostatic ion trap is to measure the oscillation frequency of ions along the z-direction. Each ion package oscillating inside the Cassinian electrostatic ion trap induces a periodic signal in an ion detector, which is electronically amplified and measured as a function of time. The ion detector comprises detection elements, such as detection coils, in which ion packages induce voltages as they fly through, or detection electrodes, for example segments of the outer electrode or inner electrodes, in which ion packages induce image charges as they fly past. Thus, in analogy to data acquisition procedures employed during operation of an ORBITRAP™ orbital trapping electrostatic trap, a Fourier transformation (or other mathematical transformation) can be used to transform a measured time signal of z-axis oscillations into a frequency spectrum, which can be converted into a mass spectrum via the known mass dependence of the z-axis oscillation frequency.

The aforementioned U.S. Pat. No. 7,994,473 teaches that ions may be preferably introduced into a Cassinian electrostatic ion trap of the type described above by introduction of the ions into the plane of symmetry (the medial y-z plane) between the two inner electrodes. Upon introduction, such ions begin oscillations parallel to at least the y-axis. Further, if the ions are introduced into the medial y-z plane at a z-axis coordinate that is not at the minimum of the z-axis harmonic potential, they will also immediately start to oscillate along the z-axis. If, however, the ions may are quasi-continuously introduced directly at the potential minimum of the harmonic potential, the ions move with only small amplitudes along the z-axis according to their initial energy in z-direction. After the ions are introduced and stored in the potential minimum in this fashion, they are excited to harmonic oscillations, for example by using a high frequency electric dipole field along the z-axis.

In an ORBITRAP™ electrostatic orbital trapping mass analyzer, ions undergo complex motions that may be represented as the superimposition of radial oscillations as well as z-axis axial oscillations upon an orbital motion around a central spindle electrode whose long dimension defines the z-axis. When ions are injected into the medial y-z plane of a Cassinian electrostatic ion trap mass analyzer having an outer electrode and two inner spindle electrodes whose long axes are parallel to the z-axis as described above, the ions undergo complex motions that may be described as a superimposition of radial oscillations within the x-y plane (but confined close to the y-z plane) upon z-axis axial oscillations. The U.S. Pat. No. 7,994,473 also teaches tangential ion injection in which the x-y motion takes the form of an orbit or orbits around the spindle electrodes. The same patent also teaches a more complex apparatus having a set of four spindle electrodes around which ions may orbit in a cloverleaf pattern.

In both the ORBITRAP™ electrostatic orbital trapping mass analyzer and the Cassinian electrostatic ion trap mass analyzer, the z-axis oscillations are mathematically separable from other oscillations and may be mathematically treated as simple harmonic oscillation parallel to the z-axis, wherein an apparent minimum in the z-axis harmonic potential occurs at a central plane of symmetry of the apparatus. In operation of either apparatus, this apparent simple harmonic motion parallel to the z-axis is used to advantage in order to obtain m/z-dependent data which may be used for the purpose of mass analysis. In operation of either the ORBITRAP™ electrostatic orbital trapping mass analyzer or the Cassinian electrostatic ion trap mass analyzer, ion injection may be effected either at or away from the apparent z-axis potential minimum (generally corresponding to a medial plane of symmetry of the apparatus). If ion injection occurs away from the minimum, z-axis oscillations begin immediately. If ion injection occurs near the minimum, z-axis motion is initially either mostly or completely suppressed but may be subsequently excited by application of a supplemental excitation voltage or voltage waveform. During operation of either type of electrostatic trap, ion density is greater at the extrema of the z-axis oscillations (the so-called "turn-around points", which are separated by about 20 millimeters in the two-spindle trap as noted in U.S. Pat. No. 7,994,473) than at the z-axis potential minimum.

Present orbital trapping electrostatic traps and mass analyzers employing such traps (such as ORBITRAP™ mass analyzers) are extensions of and improvements to earlier Kingdon traps. As a result of the above-noted similarities between the operation of ORBITRAP™ mass analyzers and Cassinian trap mass analyzers, the various known Cassinian traps and their derivatives may be referred to as "Higher Order Kingdon" traps. Moreover, because of these operational similarities, the herein-taught novel operational methods programming of the z-axis oscillation amplitudes through the superimposition of a supplemental modulation field (or fields) onto the main trapping field is applicable to either class of mass analyzer. The U.S. Pat. No. 7,994,473 teaches that the application of supplemental fields may be provided for by providing either the outer electrode or the inner electrode (or both) in the form of a plurality segments which are shaped, arranged and supplied with voltages such that the appropriate electric potential is generated, instead of providing the inner and outer electrodes as respective integral pieces. Accordingly, the supplemental electrical connections illustrated in FIGS. 5A-5C, although strictly applicable to operation of an ORBITRAP™ mass analyzer, may be modified, as necessary and as would be obvious to one of ordinary skill in the art, in order to provide the required supplemental voltages to a mass analyzer employing a Higher-Order Kingdon trap. For example, whereas only a single spindle electrode is illustrated in each of FIGS. 5A-5C, the multiple spindles of a Higher-Order Kingdon trap would preferably be electrically connected in common. As another example, although U.S. Pat. No. 7,994,473 only specifically illustrates the outer electrode of a Cassinian trap as a single integral piece, one of ordinary skill in the art may readily envisage that the outer electrode may be split into two halves, similar to the way that the outer electrodes are illustrated in FIGS. 5A-5C, such that a supplemental voltage waveform may be applied across the two halves at the same time that a common trapping voltage is being applied in common to the two halves.

The discussion included in this application is intended to serve as a basic description. Although the invention has been described in accordance with the various embodiments shown and described, one of ordinary skill in the art will readily recognize that there could be variations to the embodiments and those variations would be within the spirit and scope of the present invention. The reader should be aware that the specific discussion may not explicitly describe all embodiments possible; many alternatives are implicit. Accordingly, many modifications may be made by one of ordinary skill in the art without departing from the scope and essence of the invention. Neither the description nor the terminology is intended to limit the scope of the invention. Any patents, patent applications, patent application publications or other literature mentioned herein are hereby incorporated by reference herein in their respective entirety as if fully set forth herein.

What is claimed is:

1. A method of operating an electrostatic trapping mass analyzer, comprising:

introducing a sample of ions from a population of ions into a trapping region of the mass analyzer, wherein an established trapping field within the trapping region is such that ions of the introduced sample of ions are caused to exhibit radial motion with respect to a central longitudinal axis of the trapping region while undergoing harmonic motion in a dimension z defined by the central longitudinal axis of the trapping region, the frequency of harmonic motion of a particular ion being a function of its mass-to-charge ratio;

superimposing a multi-frequency periodic modulation field onto the trapping field within the trapping region, wherein the multi-frequency periodic modulation field comprises a plurality of frequencies, each frequency associated with a respective amplitude, wherein the multi-frequency periodic modulation field acts to either increase or reduce the harmonic motion energies of the ions by an amount varying according to the frequency of harmonic motion, and wherein either the frequencies are randomly chosen from a frequency range or the amplitudes are randomly chosen; and acquiring a mass spectrum of the ions in the trapping region by measuring a signal representative of an image current induced by the harmonic motion of the ions.

2. A method as recited in claim 1, wherein the introducing of the sample of ions into the trapping region comprises introducing the sample of ions into a trapping region of a Cassinian trap mass analyzer.

3. A method as recited in claim 2, wherein the trapping region comprises:

an outer electrode having an inner surface; and two spindle-shaped inner electrodes having respective spindle axes and respective spindle outer surfaces, wherein the spindle axes are parallel to and equidistant from the longitudinal axis, wherein the outer electrode inner surface and the spindle electrode outer surfaces are disposed and shaped such that a trapping potential corresponding to the trapping field is of the form $$U(x, y, z) = U_0 + U_C ln\left[\frac{(x^2+y^2)^2 - 2b^2(x^2-y^2) + b^4}{a^4}\right] - \frac{k}{2}(x^2+y^2) + kz^2$$

where x, y and z are Cartesian axes, z is the longitudinal axis, the x-y plane is a plane of mirror symmetry of the trapping region, and $U_0$, $U_c$, a, b and k are constants.

4. A method as recited in claim 3, wherein the superimposing of the multi-frequency periodic modulation field onto the trapping field is performed by:

applying a periodic voltage waveform between both spindle-shaped inner electrodes and the outer electrode, wherein there is no potential difference between the spindle-shaped inner electrodes.

5. A method as recited in claim 3, wherein the outer electrode comprises two separated outer electrode segments and the superimposing of the multi-frequency periodic modulation field onto the trapping field is performed by:

applying a periodic voltage waveform between both spindle-shaped inner electrodes and a one of the outer electrode segments, wherein there is no potential difference between the spindle-shaped inner electrodes.

6. A method as recited in claim 3, wherein the outer electrode comprises two separated electrode segments and the superimposing of the multi-frequency periodic modulation field onto the trapping field is performed by applying a periodic voltage waveform between the separated outer electrode segments.

7. A method as recited in claim 1, wherein the introducing of the sample of ions into the trapping region comprises introducing the ions into a trapping region defined by:

an inner spindle electrode having an outer surface that is axially symmetric about the longitudinal axis and that is symmetric about a central equatorial plane that is perpendicular to the longitudinal axis; and a pair of outer electrodes disposed at either side of the equatorial plane and having respective inner surfaces, wherein the outer surface of the inner spindle electrode and the inner surfaces of the outer electrodes are shaped such that a trapping potential corresponding to the trapping field is a quadro-logarithmic potential that is established by application of an electrostatic voltage difference between the inner spindle electrode and the outer electrodes.

8. A method as recited in claim 7, wherein the superimposing of the multi-frequency periodic modulation field onto the trapping field is performed by:

applying a periodic voltage waveform across the pair of outer electrodes or between the inner spindle electrode and one of the outer electrodes.

9. A method as recited in claim 7, wherein the superimposing of the multi-frequency periodic modulation field onto the trapping field is performed by:

applying a periodic voltage waveform between the inner spindle electrode and both of the outer electrodes, wherein there is no potential difference between the outer electrodes.

10. A method as recited in claim 1, wherein the introducing of the sample of ions into the trapping region comprises introducing the ions into a trapping region defined by:

an inner spindle electrode having an outer surface that is axially symmetric about the longitudinal axis and that is symmetric about a central equatorial plane that is perpendicular to the longitudinal axis; and a pair of outer electrodes disposed at either side of the equatorial plane and having respective inner surfaces, wherein the outer surface of the inner spindle electrode and the inner surfaces of the outer electrodes are shaped such that a trapping potential corresponding to the trapping field is a quadro-logarithmic potential that is established by application of an electrostatic voltage difference between the inner spindle electrode and the outer electrodes.

11. A method as recited in claim 10, wherein the superimposing of the multi-frequency periodic modulation field onto the trapping field is performed by:

applying a multi-frequency periodic voltage waveform across the pair of outer electrodes, between the inner spindle electrode and one of the outer electrodes or between the inner spindle electrode and both of the outer electrodes.

12. A method as recited in claim 1, wherein the superimposing of the multi-frequency periodic modulation field onto the trapping field is such that a spectral resolution of the mass spectrum is improved as compared to a mass spectrum of the sample of ions obtained using the mass analyzer in the absence of the superimposing of the modulation field onto the trapping field within the trapping region.

* * * * *